United States Patent [19]

Dalton

[11] Patent Number: 4,512,578

[45] Date of Patent: Apr. 23, 1985

[54] BALL AND TRACK GAME

[76] Inventor: Susan H. Dalton, 331 West 1200 North, Orem, Utah 84057

[21] Appl. No.: 559,944

[22] Filed: Dec. 9, 1983

[51] Int. Cl.[3] ..... A63B 67/08

[52] U.S. Cl. ..... 273/110

[58] Field of Search ..... 273/109, 110; 446/168, 446/170; 273/112, 113, 115, 116

[56] References Cited

U.S. PATENT DOCUMENTS

| | | | |
|---|---|---|---|
| 1,675,209 | 6/1928 | Brower | 273/109 |
| 3,502,335 | 3/1970 | Sholin | 273/109 |

*Primary Examiner*—Richard C. Pinkham
*Assistant Examiner*—Benjamin Layno
*Attorney, Agent, or Firm*—Trask & Britt

[57] ABSTRACT

A ball and track game comprising a truncated spheroidal-shaped base member. A tubular cannister extends upwardly from the upper surface of the base member and is provided on its surface with a closed-end, generally circular track adapted to receive a ball or other spherical object. A sleeve concentric to the tubular cannister provides an annular space in which doughnut-shaped weights can be placed. The ball is caused to move along the track by rocking the truncated spheroidal-shaped base member about its axis by applying pressure at selected points on its lower convex surface. The object of the game is to keep the ball in constant motion along the track by appropriate manipulation of the base member.

7 Claims, 3 Drawing Figures

BALL AND TRACK GAME

BACKGROUND OF THE INVENTION

1. Field

The present invention relates generally to an amusement device. More particularly, the present invention relates to a ball and track game. Still more particularly, the present invention relates to a ball and track game comprising an uninterrupted, closed-end track along which a ball is caused to continuously move by means of the manipulative actions of the game player.

2. Description of the Prior Art

The prior art is replete with hand operated amusement devices comprising a track adapted to receive and have moved there along a ball or other spherical-shaped object. Some of these devices comprise a game surface provided with an opened-end, i.e., non-continuous, track or raceway in which a ball is adapted to be received and moved along therein by means of the manipulative hand actions of the game player. The track in such games may follow a flat, or inclining or declining, path which usually is of a generally spiraling configuration. U.S. Pat. No. 3,702,191, for example, shows a ball and track game in which the track follows either an inclining or declining path, at the game player's option, of a spiraling, circular configuration, while U.S. Pat. No. 513,105 shows a game in which the track follows a declining path of spiraling, elliptical configuration. It is not uncommon, moreover, in such ball and track games of this type for the opened, end track to be made more tortuous by the inclusion of obstacles, as is done in U.S. Pat. No. 3,552,750 in which a plurality of baffles, bumps and openings are placed in the path of a flat track of spiraling, circular configuration. Whatever form the track may take in these various ball and track games, however, the object of each game is the uninterrupted movement of a ball from a first point on an opened-end track to a second point thereon by varying the position of the track-bearing surface through the hand manipulations of the game player.

There are also hand operated ball and track games in the prior art in which the path to be followed by the ball is closed-end, i.e., continuous, and usually contained within a generally dish-shaped member having a convex outer surface and a concave inner surface. U.S. Pat. No. 3,738,658, for example, shows a game in which a plurality of disks, rather than a ball, are caused to follow closed, unidentified paths about the concave surface of a bowl-shaped member as a result of the gyratory motion imparted thereto by the hand manipulations of the game player. While sustained, uninterrupted movement of the several disks about closed-end paths is the objective of the game, the paths followed by the disks are not defined by fixed tracks and, accordingly, may vary widely in their configurations from revolution to revolution.

U.S. Pat. No. 1,675,209 shows another ball and track game in which a closed-end track is contained within a generally dish-shaped member. In the game of this patent, the dish-shaped member is provided with a centrally located core extending from the bottom of its inner concave surface which cooperates with the vertically inclined walls of the surface to form an annulus constituting a closed-end track adapted to receive a ball. The object of this game, however, is not to produce continuous movement of the ball along the closed-end track but, rather, to produce movement of the dish-shaped member itself along a selected path on a support member, such movement being effected by inertial forces imparted to the ball as it moves from point to point along the track, such forces being applied by hand manipulations of the game player.

SUMMARY OF THE INVENTION

While the various ball and track games of the prior art as represented by those disclosed by the patents above referred to challenge the hand manipulating skills of the game player to varying degrees, none is a truly closed-end track game. Rather, they are either games with opened-end tracks, i.e., tracks with defined start and finish points, or games with closed-end paths, i.e., paths which while not having defined start and finish points also are not defined by the physical structure of a track, as in a closed-end track game. Accordingly, it is a principal object of this invention to provide a ball and track game having a closed-end track. It is a further object of this invention to provide a closed-end ball and track game in which the object of the game is to keep the ball in constant motion along the track so long as the game is played. It is a still further object of this invention to provide a closed-end ball and track game which can be played either by hand or by foot, thereby testing both the hand-eye and foot-eye coordinating skills of the game player. Another object of this invention is to provide a game that can be played by any age game player and which will challenge the skills of any such player. It is also an object of this invention to provide a close-end ball and track game in which certain elements of the game can be physically separated therefrom when the game is not in use and employed for other entertainment purposes.

These various objects have been met in accordance with this invention by a ball and track game comprising a base member in the form of a truncated sphere whose convex outer surface constitutes the under face upon which the base member rests on any chosen game surface. Attached by one end to the upper face of the truncated spheroidal base member and extending above the plane of truncation is a tubular cannister whose axis coincides with the axis of the base member. The upper end of the tubular cannister is provided with a top in the surface of which is located at least one closed-end generally circular track or raceway adapted to receive a movable ball, or marble or other spherical object. Concentric with the cannister and secured by one end to the base member is a sleeve of larger diameter and similar height to the cannister which, in conjunction with the cannister, forms an annular space in which is placed at least one weight element. In non-use, the game rests balanced and unmoving on the point of the axis of the truncated spheroidal base member, from which point it may be given varying rocking motions by the application of pressure at selective points around its convex under face. In playing the ball and track game of this invention, the object is to place the ball in continuous motion along the track in the top of the tubular cannister by placing the truncated spheroidal base member in appropriate rocking motions through pressure applied by the hands or feet of the game player to the convex under face of the base member.

DESCRIPTION OF THE DRAWINGS

In the drawings, which illustrate that which is presently regarded as the best mode for carrying out the invention.

DESCRIPTION OF THE PREFERRED EMBODIMENT

Figure 1:
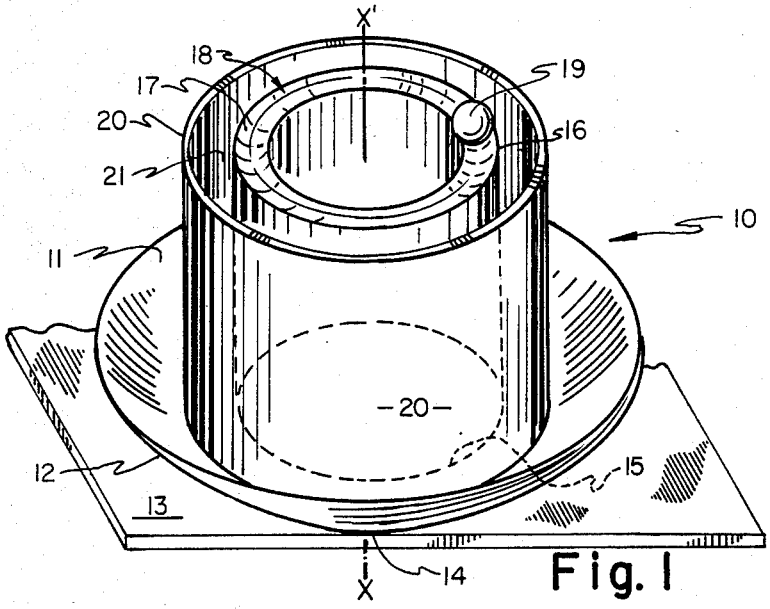
FIG. 1 is a perspective view of the ball and track game device according to this invention showing the game device in its non-use, balanced position.
Figure 2:
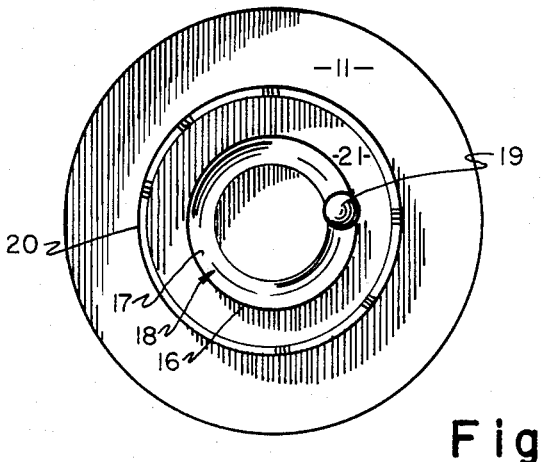
FIG. 2 is a top view of the ball and track game device of FIG. 1.

Referring now to the figures of the drawing, the ball and track game device is represented generally by reference numeral 10, and comprises a base member 11 in the form of a truncated spheroid whose convex surface constitutes the under face 12 of base member 11. The plane of truncation of base member 11 may be at varying points along the X—X' axis thereof shown in FIG. 1, but it will be below the center plane of the spheroid, and at such selected point therebelow on the X—X' axis as to insure that when game device 10 is in its non-use position, it will rest balanced and motionless with under face 12 contacting a selected support surface 13 at axial point of contact 14. Truncated spheroidal base member 11 may be solid but, preferably, is hollow thereby giving a generally open dish-shaped appearance. Whether or not open base member 11 is enclosed by a cover means at the plane of truncation is immaterial insofar as the functioning of the game device is concerned, and, accordingly, it may be closed or left open as desired.

Attached to the bottom of the concave upper face of base member 11 by one end 15 is a tubular cannister 16 whose axis coincides with the X—X' axis of base member 11. Tubular cannister 16 and base member 11 will usually be of unitary construction but they may, of course, be separately fabricated and joined in any suitable manner. The other end of tubular cannister 16 generally extends above the plane of the truncated base member 11 and forms the surface upon which the game is played. The upper limit to which tubular cannister 16 extends may vary but should always be such as to insure the balance of the game device when in its non-use position as earlier described. The extended end of tubular cannister 16 is provided with a track surface 17 into which is cut or otherwise formed a closed-end, generally circular track or raceway 18 adapted to receive a ball, marble or other suitable spherical member 19 for movement therein. Track 18 is formed in a manner so that as ball 19 rotates therein, it has its primary contact with the bottom of the track and only incidental contact with the track walls. Alternatively, track 18 can be constructed so that as ball 19 rolls along the track, it makes contact at two points on its periphery with two corresponding points along the sidewalls of track 18, but without making contact with the bottom of track 18. As with base member 11, tubular cannister 16 may be solid but preferably is hollow, in which case it is provided with an enclosure constituting track surface 17. While track surface 17 is shown in the drawing to have only one closed-end track 18, several such tracks of varying diameter can obviously be provided, thereby broadening the scope of the ball and track game and further challenging the skill of the game player.

Figure 3:
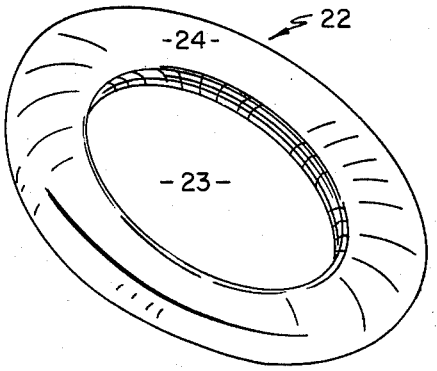
FIG. 3 is a view of weight member forming a part of the ball and track game device of FIG. 1.

Concentric with and fitted about tubular cannister 16 is sleeve 20 whose lower end is attached to the bottom of the concave upper face of base member 11, in a manner similar to cannister 16, and whose upper end terminates at approximately the plane of track surface 17 of tubular cannister 16. Formed between sleeve 20 and tubular cannister 16 is an annular space 21 whose function is to receive one or more weight members 22 shown in FIG. 3. Preferably, each weight member 22 takes the form of a doughnut having a hole 23 through which tubular cannister 16 can be inserted, the dimensions of ring 24 of weight member 22 being such as to provide a snug fit in annular space 21 against tubular cannister 16 and sleeve 20. Weight member 22 may be formed of any material suitable to provide the desired weightiness to ball and track game device 10 but, preferably, it is formed as a doughnut-shaped bag weighted in its bag by beans, rice or any similar particulate material generally used as the weight content of "bean bags".

Ball and track game 10 may be made in its entirety from any rigid metallic or plastic material, preferably the latter, in which case it can be molded as a unitary structure as earlier suggested. The size of the game device is not critical to its functionability, but its enjoyment by game players can be enhanced if it is constructed in varying sizes to accommodate different age groups of players. Moreover, since the game is adapted to be played either by hand or by foot, its enjoyment by game players may also be enhanced by using a larger version of device 10 for foot play than that which might be desirable for hand play alone. Although not shown in the drawing, track surface 17 can be provided with a clear, preferably plastic, bubble cover to contain ball 19 within the confines of the cover and track surface 17.

The ball and track game of this invention can be played by placing device 10 on any firm, level support surface, such as any variety of table for hand play, or on the floor or other low surface for foot play. By appropriate pressure placed at selected points about convex under face 12 of base member 11, device 10 can be made to rock about axis X—X' thereby imparting motion to ball 19. Through continued skillful manipulation of base member 11 administered by the hands or feet of the game player, ball 19 can be made to move in constantly repeating revolutions around closed-end track 18.

As an added feature of the ball and track game of this invention, weight member 22 can be removed from annular space 21 and used for other purposes whenever the game is not being played. Thus, for example, if weight member 22 takes the preferred form of a "bean bag", it can be used for the many forms of entertainment to which "bean bags" have been known to be put. This doughnut-shaped, ring-type device may be made of soft fabric and filled with hard or soft, resilient particulate material; e.g., beans or rice could be used as well as polystyrene pellets.

Although in its preferred embodiment the invention optimally utilizes a cylindrical cannister as the central support for the circular plate-like member on which one or more endless tracks is associated, it is recognized that a slender, solid elongated support member, i.e., a center post, would function to support the track structure. Such a slender center post would not provide lateral support for soft doughnut-shaped weight members such as those made of fabric and loosely filled with lead shot, beans or other weighty particulate material. However, if the toroidal weights are self-supporting, e.g., a hollow, rigid plastic ring filled with weight, such a structure is very serviceable.

As illustrated in the drawings, the track surface is desirably a significant distance above the upper lip or edge of the spheroidal member. The height of the track surface is preferably about one-half the diameter from one point along the lip to an opposite point along the lip. Although the track and upper edge of the sleeve are illustrated in the same plane, the track may be at a more elevated position.

The dimensions of the device may vary, although the proportional relationship of various elements of the device heretofore recited should generally be observed. The cylindrical cannister may vary in diameter from a few inches to six or eight inches and have a height of from several inches to about ten to twelve inches. Smaller versions of the device may be used to improve hand-eye coordination while a larger version may be used to improve foot-eye coordination. Intermediate sizes of the device may be used for both purposes.

Reference in this disclosure to details of the specific embodiment described is not intended to restrict the scope of the appended claims, which themselves recite those features regarded as essential to the invention.

I claim:

1. A ball and track game comprising:

a truncated spheroidal-shaped base member having a convex under face by which said device can contact and rest upon a support surface;

a centrally located elongated vertical support secured by one of its ends to the surface of the concave upper face of said base member, said elongated vertical support and said base member having corresponding axes;

at least one closed-end, generally circular track attached to the other end of said elongated vertical support, said track being adapted to receive and have move therein a ball or other spheroidal object;

a sleeve concentric with and fitted about said elongated vertical support thereby providing an annular space therebetween, said sleeve being secured by one of its ends to the bottom of the concave upper face of said base member and terminating at its other end at approximately the plane of the track surface of said tubular cannister.

2. A ball and track game according to claim 1 wherein weight means is securely positioned within said annular space.

3. A ball and track game according to claim 2 in which said weight means are doughnut-shaped.

4. A ball and track game according to claim 3 in which the doughnut-shaped weight means are bags filled with a particulate weight material.

5. A ball and track game according to claim 1 in which the track surface of said tubular cannister is provided with one closed-end track.

6. A ball and track game according to claim 1 in which the track surface of said tubular cannister is covered by a clear bubble.

7. A ball and track game according to claim 1, wherein the elongated vertical support is a tubular cannister.

* * * * *